US006446649B1

(12) United States Patent
Bigford

(10) Patent No.: US 6,446,649 B1
(45) Date of Patent: Sep. 10, 2002

(54) APPARATUS FOR ANCHORING AN UMBRELLA

(76) Inventor: Barbara Bigford, 3 Chetwynd Rd., Paoli, PA (US) 19301

( * ) Notice: Subject to any disclaimer, the term of this patent is extended or adjusted under 35 U.S.C. 154(b) by 0 days.

(21) Appl. No.: 09/660,953

(22) Filed: Sep. 13, 2000

(51) Int. Cl.[7] ..... A45B 3/00

(52) U.S. Cl. ..... 135/16; 135/22; 135/25.1; 135/902; 248/519; 248/910

(58) Field of Search ..... 135/16, 20.1, 34.2, 135/902, 22, 25.1, 25.31; 150/106, 112; 246/511, 519, 910

(56) References Cited

U.S. PATENT DOCUMENTS 3,340,919 A * 9/1967 Holbrook
3,843,079 A * 10/1974 Reisling ..... 248/44
4,296,693 A * 10/1981 Archer ..... 108/28
4,832,163 A * 5/1989 Levesque ..... 190/11
4,924,893 A 5/1990 Furey
5,143,108 A 9/1992 Kenney
5,288,150 A * 2/1994 Bearman ..... 383/38
5,323,802 A * 6/1994 Kiedrowski ..... 135/34.2
5,339,847 A 8/1994 Kanter et al.
5,427,346 A 6/1995 Urgola
5,452,877 A 9/1995 Riffle et al.
5,823,213 A * 10/1998 Patarra ..... 135/16
6,199,570 B1 * 3/2001 Patarra ..... 135/16

* cited by examiner

*Primary Examiner*—Carl D. Friedman
*Assistant Examiner*—Yvonne M. Horton
(74) *Attorney, Agent, or Firm*—Duane Morris LLP

(57) ABSTRACT

An apparatus and method for anchoring an umbrella that has a shaft are disclosed. The apparatus includes a plurality of containers that can contain a material or object that provides weight to the containers, preferably equal to the combined weight of the umbrella and the shaft.

17 Claims, 4 Drawing Sheets

APPARATUS FOR ANCHORING AN UMBRELLA

The present invention is directed to an apparatus for anchoring an umbrella. In particular, the invention is directed to an apparatus for anchoring an umbrella to the ground during outdoor use. The apparatus is applicable for anchoring a beach umbrella.

BACKGROUND OF THE INVENTION

Large umbrellas are commonly used at beaches and other outdoor recreational areas to provide protection from sun. At times, winds can topple or dislodge an umbrella. Attempts to remedy this problem include the use of spikes, threads or flanges to anchor the umbrella into the underlying surface. However, such structures may not be completely reliable in situations where winds are very high and/or the surface is of a consistency, such as fine and powdery, that does not attach securely to the structures.

Several other methods are available for anchoring umbrellas. For example, U.S. Pat. No. 5,452,877 discloses a beach umbrella anchor bag having a bottom opening. The bag is placed on an underlying surface with the bottom opening in contact with the underlying surface. The bottom opening allows an umbrella shaft or pole to be inserted therethrough into the underlying surface. The bag is filled with a material to provide weight, and attached to the umbrella shaft by panels of hook and loop material. One panel, e.g., the loop material, is affixed to the umbrella shaft with the loop surface exposed, and one or more panels of mating material, e.g., the hook material, are affixed to the bag. However, the bag is necessarily large and, if the opening in the bottom of the bag is sufficiently large, material that is inside the bag to provide weight may leak out, either gradually or suddenly if the umbrella is displaced such as by a strong wind.

U.S. Pat. No. 4,924,893 discloses a container in the form of a beach bag that is affixed to a beach umbrella by a flexible cable member to anchor the umbrella. The beach bag may be filled with sand to provide weight for anchoring the umbrella. If the bag has sufficient weight, the umbrella may be prevented from blowing away. However, the disclosure fails to show how the umbrella can be prevented by the bag from being toppled.

A need remains for methods and devices for anchoring umbrellas, particularly beach umbrellas, so that they remain substantially in a desired position when subjected to moderate winds.

SUMMARY OF THE INVENTION

One aspect of the present invention is an apparatus for anchoring an umbrella having a central shaft. The apparatus includes a plurality of containers removably connected to a ring disposed about the shaft of the umbrella. The ring is capable of gripping the umbrella shaft. In preferred embodiments, the ring has an inner diameter substantially equal to that of the umbrella shaft so that when the ring is disposed about the umbrella shaft, a friction seal is formed between the ring and the umbrella shaft. In some embodiments, the ring is made of a deformable material. In some embodiments, the ring has an adjustable inner diameter, and said inner diameter can be adjusted to be substantially equal to the diameter of the shaft of the umbrella. One or more of the containers contain a material and/or object that provides weight to anchor the umbrella. In some preferred embodiments, the containers and any material or objects contained therein have a combined weight equal to at least about the total combined weight of the umbrella and shaft.

Another aspect of the invention is a method for anchoring an umbrella having a shaft. The method includes providing a ring made of a deformable material; disposing the ring about the shaft of the umbrella; removably attaching to the ring a plurality of containers; and placing into one or more of the containers a material or object to provide weight to anchor the umbrella.

A further aspect of the invention is an apparatus for anchoring an umbrella having a shaft. The apparatus includes a plurality of containers, each container capable of holding a material without spillage when the container is in an upright position, the plurality of containers being attached to each other, and capable of arrangement so as to surround and contact the umbrella shaft; and a ring that is capable of gripping the umbrella shaft when placed onto the shaft, each of the plurality of containers being attachable to the ring.

These and other aspects of the invention will be apparent to those skilled in the art in view of the present disclosure and the appended claims.

DETAILED DESCRIPTION

The present invention provides apparatuses and methods for anchoring an umbrella. The apparatuses are suitable for outdoor use on a beach or other recreational area, where an umbrella having a central shaft that may be inserted into an underlying surface might be subjected to winds that could dislodge the shaft from the underlying surface. The apparatuses include containers into which one or more substances or objects can be placed, to provide weight and anchor the umbrella.

Figure 1:
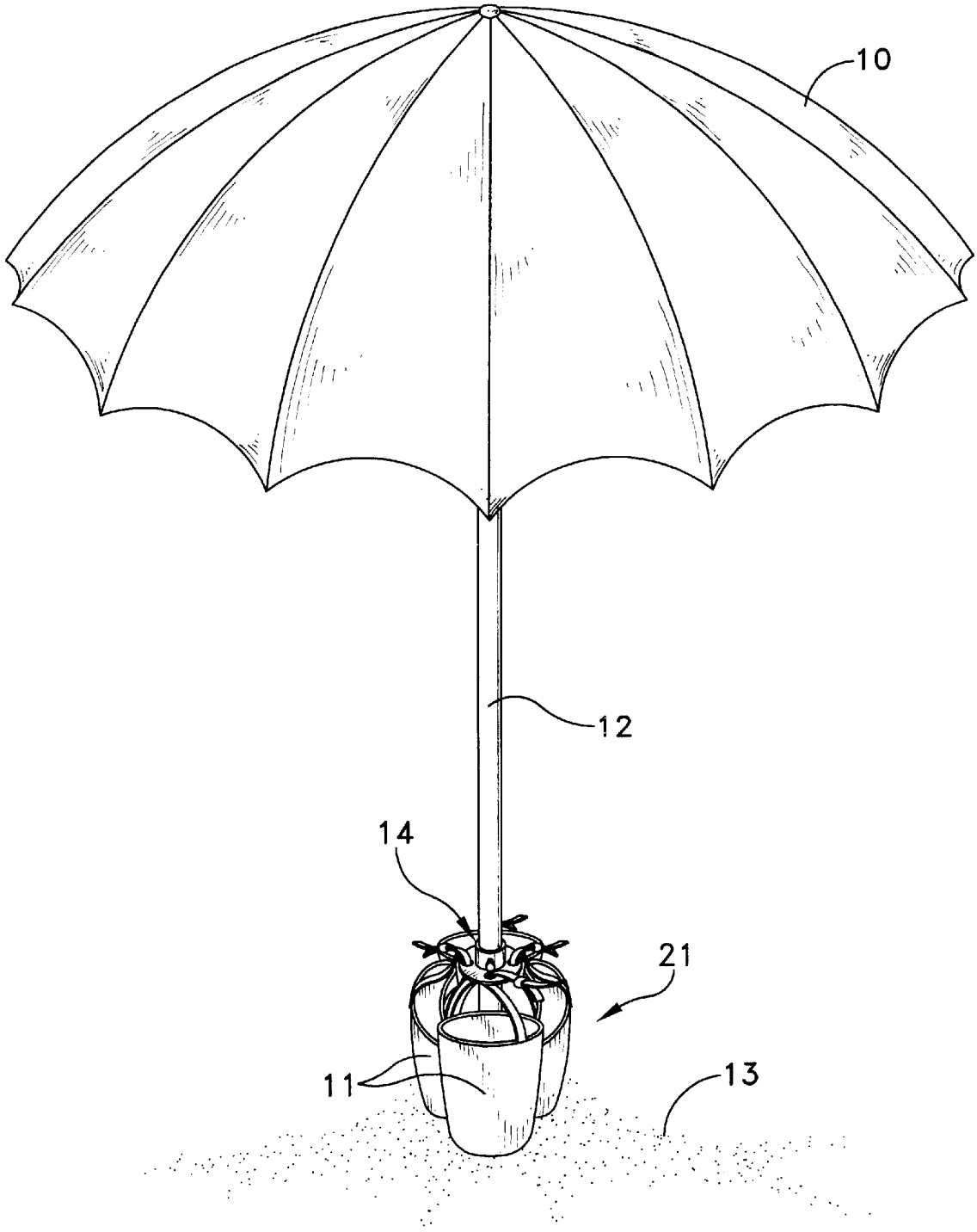
FIG. 1 shows a preferred embodiment of an apparatus for anchoring an umbrella as described herein. The apparatus is shown in place, attached to an umbrella.

Exemplary embodiments of the invention are now described in detail with reference to the Figures. FIG. 1 shows an exemplary embodiment of an apparatus 21 in accordance with the present invention. Umbrella 10 has a central shaft 12 and is anchored by containers which, in the embodiment shown, are flexible containers in the form of bags 11, substantially filled with a material such as sand, to provide weight to the bags. In preferred embodiments, the bags and the material contained therein together have a weight about equal to or greater than the weight of the umbrella 10, more preferably equal to or greater than the combined weight of the umbrella 10 and the shaft 12.

The umbrella shaft 12 is inserted into the underlying surface 13, which may be sand or earth. The depth to which the umbrella shaft 12 is inserted is not critical; however it is generally preferred that the umbrella shaft be inserted to a depth such that resistance is met when an attempt is made to remove the umbrella shaft from the underlying surface 13. For example, the shaft 12 may be inserted into the underlying surface 13 to a depth of about 6, 12, 18, or 24 inches or more. It is not necessary that the umbrella shaft 12 have any auxiliary structures spikes, threads, flanges or other structures thereon, to supplement the anchoring of the umbrella due to the bags and the material contained therein. The absence of such auxiliary structures may be preferred for safety or ease in handling. However, umbrellas having such auxiliary structures are within the scope of the invention.

Substances that can be placed inside the containers 11 to provide weight include, for example, inorganic materials such as sand, dirt, rocks, and pebbles. If the containers are able to hold liquid, e.g., if the containers are buckets, water or other liquid can be placed inside the containers. Also, if desired, one or more of the containers can be used to transport articles such as shoes, toys, beverages, and the like to a beach or recreational area, and the containers can be filled with sand or other materials when the articles are removed. In particularly preferred embodiments, when the apparatus is used at a beach to anchor a beach umbrella 10, sand can be placed into one or more of the containers 11 when the umbrella is placed into position on the surface 13 of the beach, which alleviates the necessity to carry to the beach any materials or objects to provide weight to the containers.

The containers 11 can be flexible containers made of any material that is able to be folded or compressed for carrying or storage, and able to substantially resume its initial shape. Examples of materials suitable for flexible containers 11 include woven or non-woven fabric; polymeric materials, particularly plastics such as polyethylene; and woven or non-woven fabric coated with plastic or other polymeric materials. Preferred fabrics include nylon, with rip-stop nylon being highly preferred. In some highly preferred embodiments, the flexible containers are made of coated or extra-strength rip-stop nylon fabrics, such as fabrics used in making parachutes. Such fabric, known as "parachute cloth" or "parachute fabric", provides advantages of strength, durability, and substantial impermeability, without eliminating flexibility. Such fabrics are commonly referred to as "zero-porosity" fabrics because they exhibit minimal permeability to air, which is highly desirable in fabrics used for parachutes. In the exemplary apparatus 21, such "zero-porosity" fabrics or fabrics having similar properties are desirable because they can hold sand or other materials with minimal or no leakage of the material. Such fabrics are generally stronger than conventional synthetic fabrics, and may have tear strengths of 5, 10, 15, 20 or more pounds, even up to about 50 pounds. Also, parachute fabrics generally have a porosity to air of less than about 13 cubic feet per minute. However, while fabrics meeting criteria of strength and porosity suitable for use in parachutes may be advantageous for flexible containers of the apparatuses described herein, such criteria are generally not required and conventional synthetic fabrics such as rip-stop nylon or polyester can be used.

Figure 4:
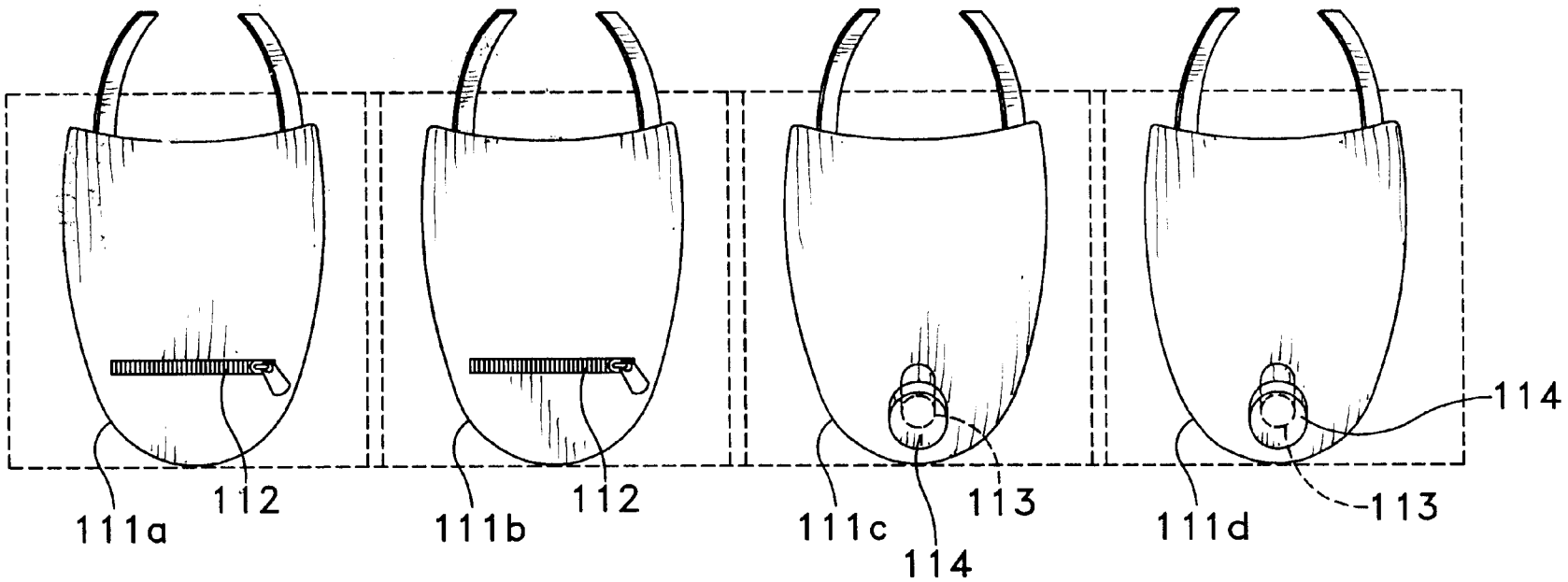
FIG. 4 shows a variation of the container assembly of FIG. 1.

Having a plurality of containers 11 allows a user to modify the amount and distribution of weight of material placed into the containers. Also, in contrast to the anchoring device described in U.S. Pat. No. 5,452,877, the plurality of containers 11 used in the apparatus described herein can be placed upright, i.e. with an opening for placing material into the containers disposed at the uppermost portion of a container rather than at the bottom of the container as described in the '877 patent. Having an opening at the top of a container rather than the bottom can minimize or eliminate leakage of material from the container. Furthermore, the container can be inverted to empty out material such as sand from the container, for example, in preparation for transport of the umbrella after use. Optionally, as shown in FIG. 4, each container 111*a–d* may have a sealable opening at its bottom, sealed by, for example, a zipper 112, plug, or spout 113 having a screw-off cap 114. Such a bottom opening can be used to empty out sand or other material from the container.

The size and number of containers is not critical. However, it has been found that 3 to 5 containers, especially 4 containers, may be advantageous if the containers are sized such that they can hold up to about 2 liters. For example, containers in the form of bags and large enough to hold an average pair of adult's shoes are particularly suitable. Larger containers, such as containers capable of holding 3, 4, or 5 liters may be used if desired. Preferably, the containers 11 are capable of arrangement so as to surround and engage the umbrella shaft 12 substantially evenly about the shaft, to provide improved stability.

The containers 11 are removably attached to a ring 14 that is preferably made of a deformable material, and which is disposed about the shaft of the umbrella. "Deformable material" means a material that has a relaxed configuration and can undergo deformation to a stressed configuration, for example, by stretching. Examples of suitable deformable materials include natural and synthetic rubbers, silicone polymers, and plastics.

Figure 2A:
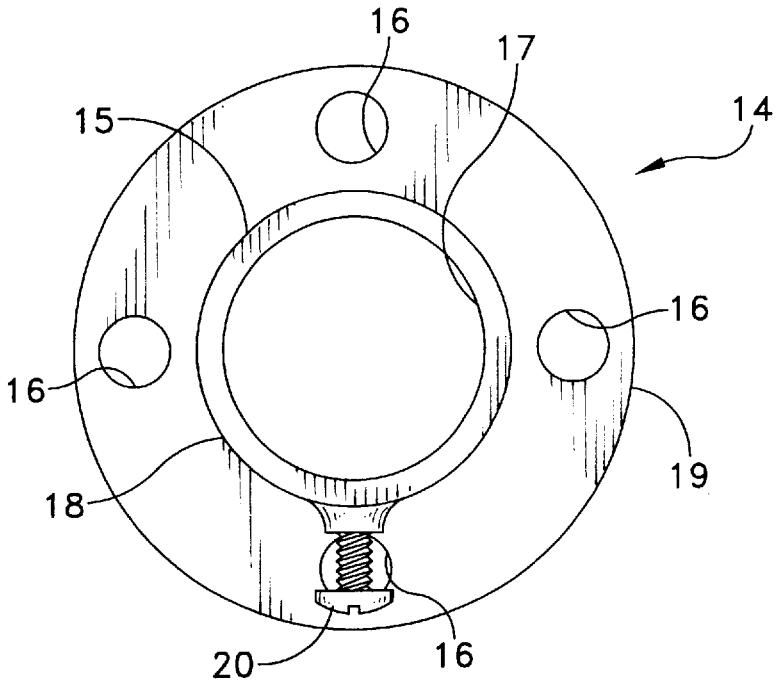
FIG. 2(*a*) is a top plan view and FIG. 2(*b*) is a perspective view of an attachment ring for attaching an apparatus to an umbrella.
Figure 2B:
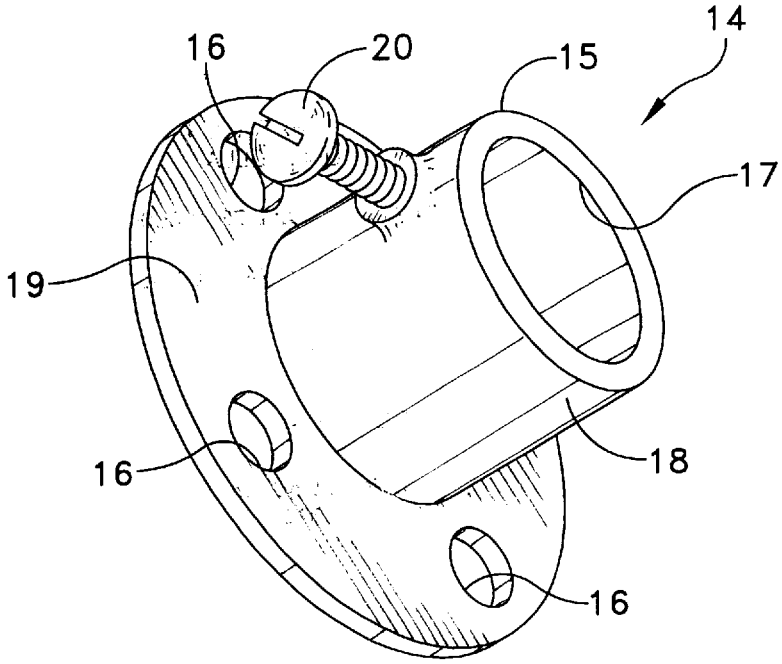

FIG. 2(*a*) is a top plan view and FIG. 2(*b*) is a perspective view of a ring 14 for use in an exemplary embodiment of the invention. In the embodiment shown in FIGS. 2(*a*) and 2(*b*), the ring includes a substantial circular body 15, flange 19 apertures 16, inner surface 17 and outer surface 18. The inner surface 17 is disposed adjacent to the umbrella shaft and the outer surface 18 is disposed away from the umbrella shaft when the ring is in place on the umbrella shaft as in FIG. 1. The ring 14 preferably has an adjustable inner diameter, such that the inner diameter can be made substantially equal to the outer diameter of the umbrella shaft 12. In the exemplary embodiment shown, set screw 20 provides adjustment of the inner diameter of the ring 14, and functions to secure the ring to the umbrella shaft. Alternatively, adjustment of ring diameter may be provided in other ways known to those skilled in the art, including the use of clamps.

The substantially circular body 15 may be made of a plastic such as polyethylene; or a rigid material such as aluminum, polycarbonate, steel or a composite material. In alternative embodiments, ring body 15 may comprise two concentric substantially circular rings, namely an inner ring (not shown) and an outer ring, substantially in the form of ring body 15. The outer ring may have a recession (not shown) on its inner surface 17 such that the inner ring may be engaged with the outer ring by fitting the inner ring into the recession. The inner ring is made of a deformable material, and the outer ring may be made of any material that can be configured into a ring with apertures 16. For example, the outer ring may be made of a rigid plastic, a metallic substance, or a composite. The outer ring may have an adjustable diameter so that it may be compressed about the umbrella shaft and the inner ring. The inner ring provides a friction seal between the ring and the umbrella shaft.

Figure 3:
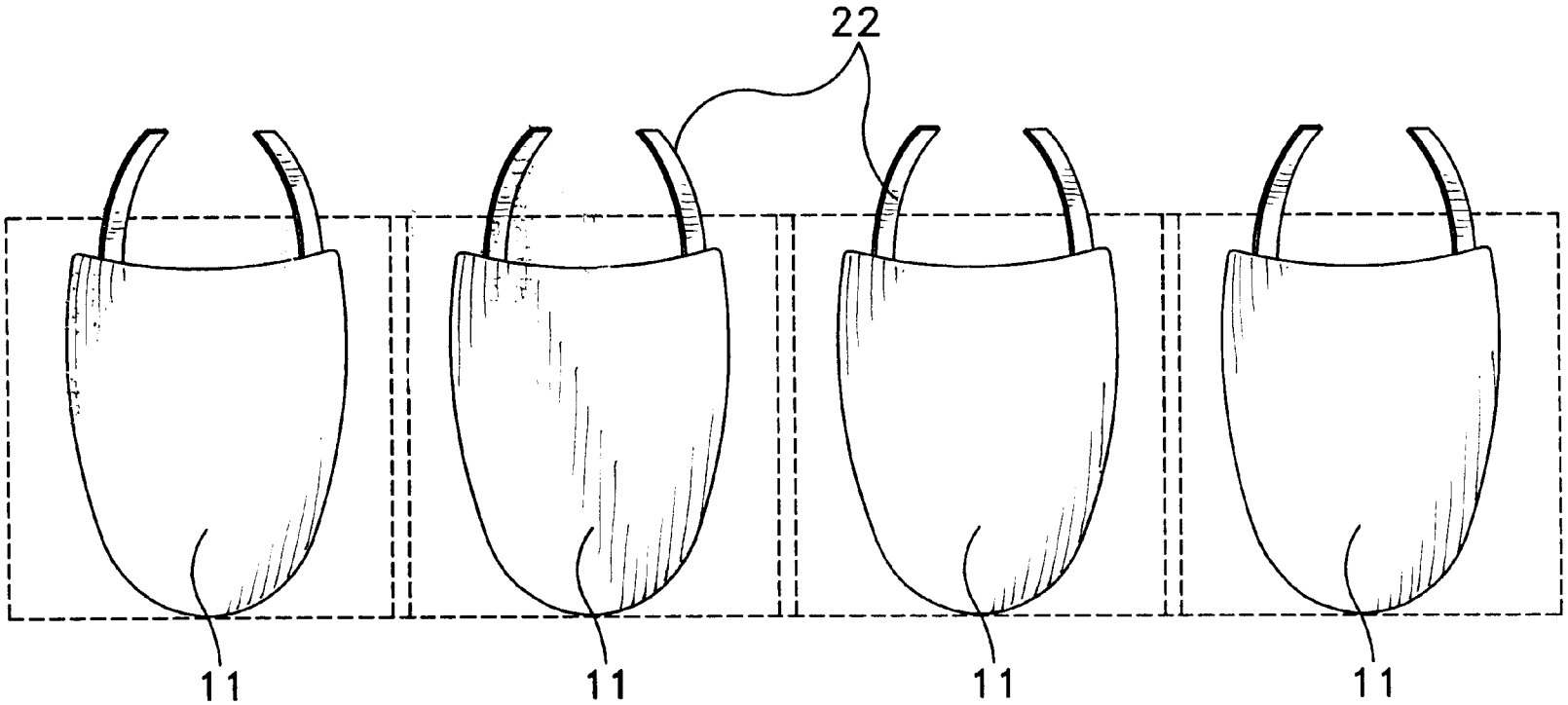
FIG. 3 shows the container assembly of FIG. 1, unfolded in a flat configuration.

Attachment of the containers 11 to the ring 14 may be facilitated, for example, by extensions 22 of the fabric or other material of which the containers are made. Such extensions 22 may be long enough to be drawn through the ring and tied, as shown in FIG. 3. Alternatively, attachment means such as snaps, buttons, or hook-and-loop closures can be affixed to the extensions and used to attach the containers 11 to the ring 14. When the containers are buckets, bucket handles may function to attach the containers to the ring.

FIG. 3 shows four flexible containers 17 suitable for use in preferred embodiments of the invention. Each container 11 has two extensions 22 in the form of ties. Ring 14 is slid onto the umbrella shaft 12 and located at a desired height. The extensions 22 can be drawn through apertures 16 on ring 14 and tied.

Thus, for example, in comparison to the apparatus disclosed in the '877 patent, the umbrella 10 is less likely to be lifted away from the containers by a gust of wind because the friction seal between the ring and the umbrella shaft can resist upward motion of the umbrella.

In alternative embodiments, the ring may be made substantially entirely of a deformable material such as rubber. A ring made of a deformable material may have, in a relaxed configuration, a diameter substantially equal to the diameter of the umbrella shaft. If the ring forms a friction seal with the umbrella shaft, the ring may not have an inner diameter that is adjustable by an auxiliary means such as a set screw or clamp. The ring may have apertures therein for receiving extensions of containers 11.

In other embodiments, the umbrella shaft may be a unitary structure such that a ring is not required. For example, the ring, having apertures therein, may be an integral part of the umbrella shaft. In some embodiments, the umbrella shaft may be constructed by molding a plastic material, such that the umbrella shaft includes a ring and/or one or more projections from the shaft, having apertures therein for receiving extensions of containers. A plurality of projections substantially in the form of loops may extend from the umbrella shaft, for receiving extensions of the containers. In other embodiments, the shaft may have apertures therein, disposed about the circumference of the shaft, for receiving extensions of the containers. In such embodiments, adjacent pairs of apertures in the forms of holes, slits or the like, can provide for attachment of the containers by threading the extensions therethrough. Materials of which an umbrella shaft including a ring and/or apertures can be made include plastics, especially thermoplastics, such as olefin polymers, styrene plastics, vinyl polymers and acrylics. Specific examples of such materials include polyethylene, polycarbonate, acrylics including polymethyl methacrylate, polyvinyl chloride. Other suitable materials and methods for forming an umbrella shaft having apertures for receiving extensions of containers will be apparent to those skilled in the art.

In other embodiments, a kit may include an umbrella having a shaft and a plurality of containers removably attached to the shaft and capable of anchoring the umbrella. The containers are preferably attached to the umbrella shaft by a ring capable of gripping the shaft. The ring may be made of a deformable material. Alternatively, the ring may have an adjustable inner diameter.

Although the invention has been described in terms of exemplary embodiments, it is not limited thereto. Rather, the appended claims should be construed broadly to include other variants and embodiments of the invention which may be made by those skilled in the art without departing from the scope and range of equivalents of the invention.

What is claimed is:

1. An apparatus for anchoring an umbrella having a shaft, said apparatus comprising a plurality of containers removably connected to a ring adapted to be disposed about said shaft, one or more of said containers being capable of containing therein at least one of the group consisting of a substance and an object having weight.

2. The apparatus of claim 1, wherein said ring is made of a deformable material.

3. An apparatus for anchoring an umbrella having a shaft, said apparatus comprising a plurality of containers removably connected to a ring adapted to be disposed about the shaft, one or more of said containers being capable of containing therein at least one of the group consisting of a substance and an object having weight, wherein said ring has an inner diameter such that when said ring is disposed about said umbrella shaft, said ring and said umbrella shaft form a friction seal.

4. The apparatus of claim 3 wherein said ring has an adjustable inner diameter.

5. The apparatus of claim 3 wherein said ring is substantially circular.

6. The apparatus of claim 3 wherein said containers and said object or substance have a combined weight of at least about the weight of the umbrella and shaft, when said object or substance is placed in said containers.

7. The apparatus of claim 3, comprising at least four containers.

8. The apparatus of claim 3, wherein said containers comprise woven or non-oven fabric.

9. The apparatus of claim 4, wherein said fabric is a synthetic fabric.

10. The apparatus of claim 4, wherein said fabric comprises nylon.

11. The apparatus of claim 5, wherein said fabric comprises rip-stop nylon.

12. The apparatus of claim 3, wherein said containers comprise buckets.

13. A method for anchoring an umbrella having a shaft, comprising providing a ring made of a deformable material; removably attaching to the ring a plurality of flexible containers; disposing the ring about the shaft of the umbrella; and placing into one or more of the flexible containers a material or object to provide weight sufficient to anchor the umbrella.

14. The apparatus of claim 3, wherein each container is capable of holding a material without spillage when the container is in an upright position and when the umbrella is being anchored.

15. A combination comprising:

an umbrella having a shaft;

a plurality of containers, each container capable of holding a material without spillage when the container is in an upright position and when the umbrella is being anchored, the plurality of containers being capable of arrangement wherein the containers surround the umbrella shaft; and a ring that is capable of gripping the umbrella shaft when placed onto the shaft, each of the plurality of containers being attachable to the ring.

16. A combination comprising:

an umbrella having a shaft, said shaft having a circumference;

a plurality of containers, each container capable of holding a material without spillage when the container is in an upright position, the plurality of containers being capable of arrangement wherein the containers surround the umbrella shaft; and apertures disposed about said circumference of said umbrella shaft, each of the plurality of containers being attachable to said umbrella shaft at said apertures.

17. An apparatus for anchoring an umbrella having a shaft, said apparatus comprising a plurality of containers removably connected to a ring disposed about said shaft, wherein the ring is formed from a material capable of retaining its shape, and wherein one or more of said containers is capable of containing therein at least one of the group consisting of a substance and an object having weight.

* * * * *